United States Patent [19]

Ornati

[11] 4,300,455

[45] Nov. 17, 1981

[54] LEG STRUCTURE FOR TABLE, CHAIR OR THE LIKE

[76] Inventor: Ernesto Ornati, 59 Matthes Rd., Briarcliff Manor, N.Y. 10510

[21] Appl. No.: 38,832

[22] Filed: May 14, 1979

[51] Int. Cl.[3] ..... A47B 47/04

[52] U.S. Cl. ..... 108/156; 248/188; 297/440; 403/231

[58] Field of Search ..... 108/156, 153; 248/188; 297/440, 446, 447, 419; 403/231, 263, 230

[56] References Cited

U.S. PATENT DOCUMENTS

| | | | |
|---|---|---|---|
| 138,718 | 5/1873 | Wattles | 248/188 |
| 693,197 | 2/1902 | White | 297/440 X |
| 1,154,692 | 9/1915 | Dehullu | 108/156 X |
| 1,257,389 | 2/1918 | Platt | 297/440 X |
| 1,389,008 | 8/1921 | Pohle, Jr. | 248/188 |

FOREIGN PATENT DOCUMENTS

| | | | |
|---|---|---|---|
| 1053643 | 2/1954 | France | 108/156 |
| 251618 | 11/1947 | Switzerland | 108/153 |
| 632628 | 11/1949 | United Kingdom | 248/188 |

*Primary Examiner*—William E. Lyddane
*Attorney, Agent, or Firm*—Amster, Rothstein & Engelberg

[57] ABSTRACT

A detachable leg structure for an article of furniture such as a table, chair or the like that has cooperating structure on both the leg and the furniture so that the resultant structure is of high strength, aesthetically pleasing in appearance and easy to both assemble and disassemble. The high strength is a direct result of the large area of surface contact between the leg assembly and the remainder of the article of furniture.

12 Claims, 9 Drawing Figures

LEG STRUCTURE FOR TABLE, CHAIR OR THE LIKE

The present invention generally relates to the construction of articles of furniture having legs such as tables or chairs and, in particular, to a detachable leg structure for such furniture that exhibits high strength and pleasing appearance, yet is economical to manufacture and, by virtue of its novel structure, is readily detachable from the piece of furniture for ease of shipment.

Present methods of construction of furniture typically utilize means of attaching legs to tables, chairs and the like that either sacrifice strength, pleasing appearance, economy or ready detachability in order to provide a joint that is useful. For example, the chair structure disclosed in U.S. Pat. No. 1,644,336 to Gunlocke, et al., or U.S. Pat. No. 1,480,905 to Hebert disclose chair frame and leg structures that utilize many individual parts and require a large amount of assembly in the area where the legs are fastened to the frame. Specifically, the '336 patent involves the use of tenons cooperating with mortises or slots, angle blocks or gussets and metal angle brackets at each of the four corners. Likewise, the '905 patent utilizes triangular braces, dowels, and interlocking leg and frame components. Neither of these references disclose structure that is readily detachable.

U.S. Pat. No. 3,529,555 to Dean provides a reinforced construction for furniture that incorporates a welded fabrication of a metal, rectangular cross-section leg and a thick metal plate. The wooden frame portion requires that the table side pieces have cutout portions which receive the steel plate. The leg and plate fabrication is bolted to the side stringers and provides substantially the entire strength of the leg construction of the table. An outer wooden leg covers the metal inner legs and merely serves aesthetic rather than structural purposes. Consequently, all of the prior art references known to Applicant fail to provide a structure that is strong, aesthetically pleasing and economical without sacrificing the ability to dismantle the article of furniture by removing the legs.

Consequently, it is an overall object of the present invention to provide an improved, detachable leg structure for an article of furniture that overcomes the shortcomings of the prior art.

It is a specific object of the present invention to provide an improved leg structure for an article of furniture such as a table, chair or the like that exhibits high strength yet can readily be disassembled.

It is a further object of the present invention to provide a structure for an article of furniture which is aesthetically pleasing and compatible with different styles or motiffs of furniture design.

It is a further object of the present invention to provide a structure that allows near flat shipment of articles of furniture incorporating this invention.

It is a still further object of the present invention when used in conjunction with a table to provide a structure that allows interchangeability of legs and table tops thereby minimizing the quantity of goods that must be kept in inventory.

As the present invention is not limited to a particular size, but is equally applicable to substantially any scale, for the purposes of this application wherever relative size is significant, the dimension is given in "units."

In accordance with one embodiment of the present invention demonstrating objects and features of the present invention, there is provided a leg structure for an article of furniture such as a table or chair. This structure comprises a leg assembly having four members of square unit cross-section. The first and second member of the leg assembly extend the entire length of the leg assembly, while the third member extends one unit less than the entire length of the leg assembly and the fourth member extends two units less than the entire length of the leg assembly. The furniture assembly includes top portion having a corner, a thickness of at least one unit, and a longitudinal skirt extending downwardly from the bottom surface of the top portion at least one unit and a lateral skirt extending downwardly at least one unit from the bottom surface of the top portion. The longitudinal and lateral skirt intersect at the corner and extend downwardly from the bottom surface of the top portion a unit for a distance starting at two units laterally and one unit longitudinally from the corner of the furniture assembly. The assembly also includes a cut-out having a first cut-out portion extending upwardly a distance of two units and extending inwardly laterally two units through the lateral skirt and the top portion and one unit longitudinally through the longitudinal skirt and the top portion. A pin extends upwardly from the fourth member a distance of substantially one unit and the longitudinal skirt includes a pin receiving hole therein. Means for detachably fastening the leg assembly to the furniture assembly are also provided.

The above brief description as well as further objects and features and advantages of the present invention will be more fully understood by reference to the following detailed description of the presently preferred, but nonetheless illustrative embodiment of an improved detachable leg structure for an article of furniture in accordance with the present invention, when taken in conjunction with the accompanying drawings, wherein.

Figure 1:
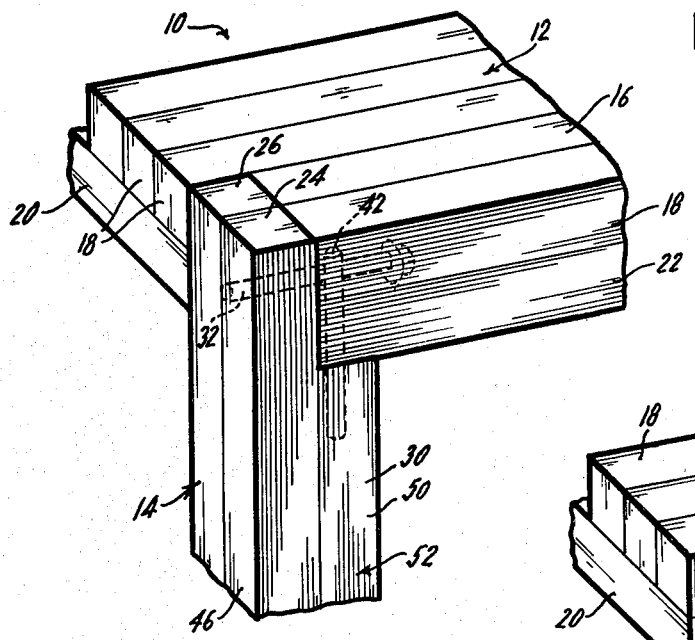
FIG. 1 is a perspective view from the top of one corner of an article of furniture showing the detachable leg structure of the present invention.

Referring now to the drawings, and in particular, to FIG. 1, there is shown a table generally designated by the reference numeral 10 incorporating the improved detachable leg structure of the present invention. It should be understood, however, that although the drawings relate to a table, the leg structure of this invention could be utilized in tables, chairs, desks, consoles and similar articles of furniture. For the sake of illustration, however, reference is made to a table.

The improved leg structure of table 10 is comprised of two major subassemblies, the furniture assembly, which in this case, is a table top 12, and the leg assembly 14. The table top 12 shown in FIG. 1 is made up of a top portion 16 formed from a plurality of individual, longitudinally extending pieces of wood 18, having a square cross-section. For the purposes of this discussion, each individual piece of wood is of the type generally referred to as a "two by two", which in actuality, is one and one-half inches by one and one-half inches in cross-section. Consequently, for the purposes of the discussion of the preferred embodiment, a "unit" will refer to the dimension of one and one-half inches. As discussed above, it should be understood, however, that other sizes can be used and the unit dimension will vary accordingly.

Figure 4:
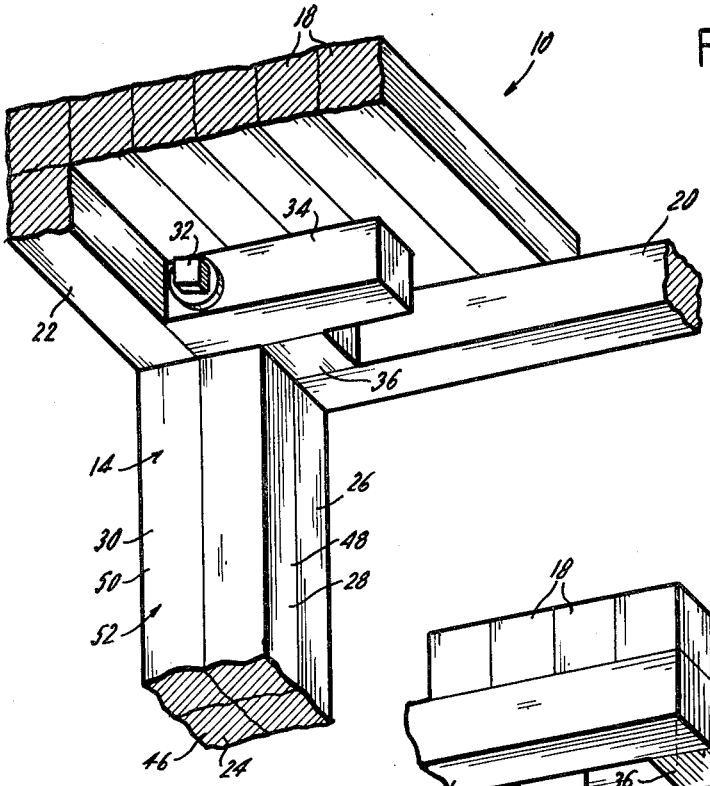
FIG. 4 is a bottom perspective view of an assembled corner of a table top incorporating the structure of the present invention.

The top portion 16 of the table top assembly 12 can be made in any desired width by varying the number of pieces of wood 18. The thickness of the top portion 16 is one unit; however, as best shown in FIG. 4, there is a lateral skirt 20 and a longidudinal skirt 22 fastened to the top portion 16 along the periphery of the top portion 16, which gives that portion a better appearance. The additional details of construction of the table top assembly 12 are discussed below.

Figure 2:
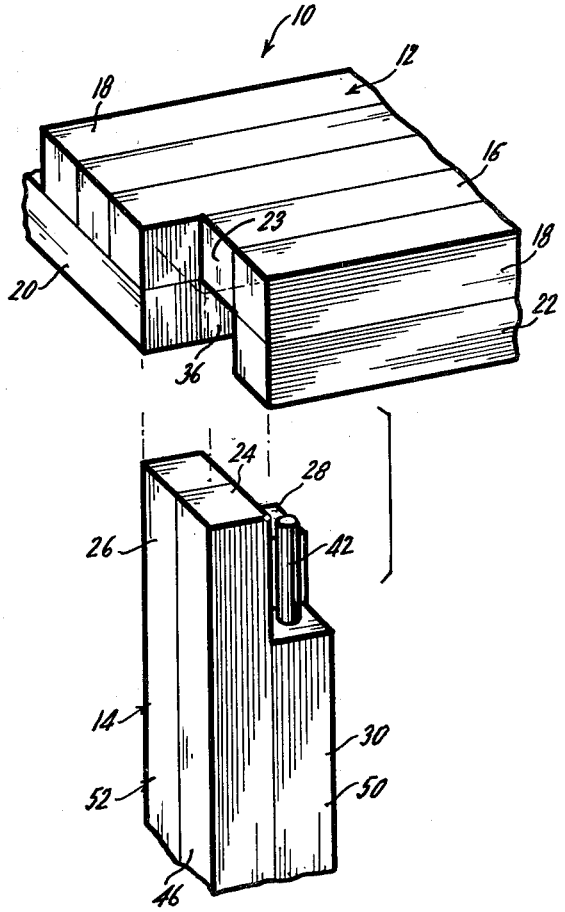
FIG. 2 is a perspective view of the same corner of the table showing the leg assembly removed from the table top.

When the table top assembly 12 and leg assembly 14 are assembled, as shown in FIG. 1, the top of the table 10 has a smooth corner. As shown in FIG. 2, when leg assembly 14 is removed from table top assembly 12 by moving leg assembly 14 downward, top portion 16 of table top assembly 12 exhibits a notch 23 that extends inwardly, laterally two units and inwardly, longitudinally one unit.

The leg assembly 14 is comprised of four individual members, each having substantially the same square cross-section of unit length. The first member and second member 24, 26, extend the entire length of leg assembly 14. Third member 28, however, terminates one unit below first member and second member 24, 26. Fourth member 30 terminates two units below first and second member 24, 26.

As best shown in FIG. 1, when leg assembly 14 is fully engaged within table top assembly 12, the topmost surface of first and second members 24, 26 are flush with the top surface of table top assembly 12.

As best shown in FIG. 4, the bottom view of the completed assembly of table top 12 and leg assembly 14, exhibits a clean appearance. In order to maintain the leg assembly within table top assembly 12, a lag bolt 32 or similar fastening means is utilized. The bottom surface of top portion 16 of table top assembly 12 also has a lateral strut 34 fastened thereto. Lateral strut 34 is fastened at one end to longitudinal skirt 22 and, if desired, can run substantially the entire width of top portion 16 and be fastened to a second longitudinal strut 22 on the opposite side of the table. Lateral strut 34 is substantially parallel to lateral skirt 20 and is mounted to the bottom surface of the top portion 16 at a distance of one unit from lateral skirt 20. A spacer 36, having a length of one unit, is bonded to lateral skirt 20 and lateral strut 34 at a lateral distance of two units from the side of top portion 16 and cut-out 35 is defined. Lateral strut 34 may also be cut flush with the inner-most surface of spacer 36 for an even cleaner appearance of the bottom surface of the assembly.

Figure 5:
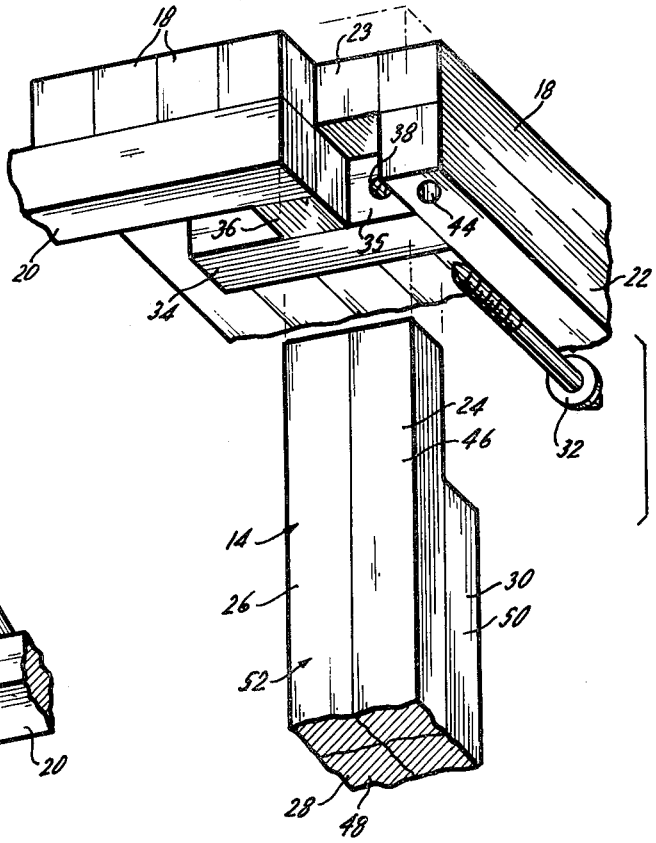
FIG. 5 is a bottom perspective view of the assembly of FIG. 4 with the leg assembly detached from the table top, rotated 180° from the orientation of FIG. 4; and, FIG. 6 is a bottom perspective view of the corner of FIG. 4 showing the disassembly of the leg assembly from the table top.
Figure 6:
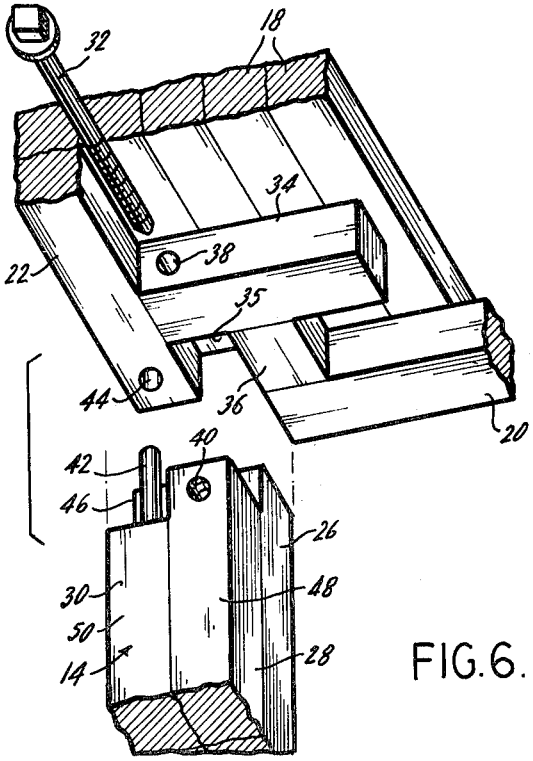

Lag bolt 32 (See FIGS. 5, 6) passes through clearance hole 38 in lateral strut 34 and engages pilot hole 40 in third member 28.

Figure 3:
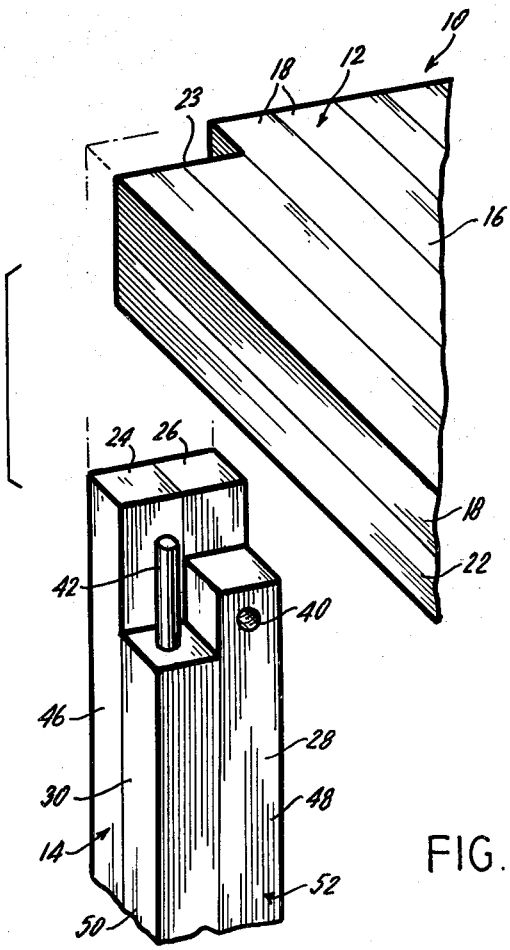
FIG. 3 is a perspective view of the table and disassembled leg assembly of FIG. 2, rotated 90° in a clockwise direction.

As best shown in FIG. 3, pin 42 extends upwardly from fourth member 30 at a distance of substantially one unit from the top-most surface of fourth member 30. Pin 42 is received within locating hole 44 in longitudinal skirt 22.

An article of furniture incorporating the detachable leg structure of the present invention can be readily assembled. Therefore, it is feasible to sell tables or similar articles of furniture with the leg assembly 14 removed from table top assembly 12. In those instances where leg assembly 14 is shorter than the length of table top assembly 12, it is possible to pack such a table for shipment in a substantially flat container. Each leg assembly can be placed against the bottom surface of top portion 16 of table top assembly 12 and will only extend one unit below the bottom of lateral and longitudinal skirts 20, 22. Consequently, the overall package is only three units thick.

To assemble the article of furniture including the leg structure of the present invention, leg assembly 14 need merely be inserted into table top assembly 12 in such manner that pin 42 is received in locating hole 44 in longitudinal skirt 22. Leg assembly 14 is slid into engagement with table assembly 12 until the top surface of third member 28 and top surface of fourth member 30 engage the bottom surface of top portion 16 and longitudinal skirt 22, respectively. At such point, lag bolt 32 is inserted through clearance hole 38 into pilot hole 40 and tightened. The remaining legs are assembled in a similar manner and the assembly of the table is complete.

This ease of assembly enables a retailer to stock a small quantity of table top assemblies and a quantity of leg assemblies of varying height. A customer can then choose a table top assembly of the appropriate size and leg assemblies of the appropriate height, depending upon whether the table will be used as a cocktail table, a dining room table and so forth.

The leg structure of the present invention is ideally suited for tables of the style known as a "Parson's Table." However, by varying the shape of the skirts and the overall cross-section of the leg assembly 14 throughout its length, it would be possible to utilize this invention in tables of more traditional styles. If the table top assembly 12 had an additional thickness of wood pieces 18, the leg structure of the present invention could be used to construct an article of furniture that had a top surface without a cut-out.

It is also anticipated that articles of furniture incorporating the present invention could be covered with veneer or mica, i.e., Formica, if it is desired not to show the wood grain. In such cases, the leg assembly may no longer be detachable from the table top assembly; however, the increased strength and rigidity of the table joint of the present invention would prevent cracking of the veneer or mica.

It is also possible to vary the number of members comprising the leg assembly and the cooperating elements in the top assembly. For example, an additional second member 26 and an additional third member 28 can be added to leg assembly 14 and table assembly 12 modified according to result in a modification of the present invention for a leg structure having an overall cross-section that is rectangular (not shown). Such modified structure would provide greater strength as well as more material in the leg assembly 14 remote from the table assembly 12 to allow the bottom portion to be carved or otherwise shaped in a decorative manner.

The leg structure of the present invention is substantially stronger than other structures that would give similar appearances . For example, if a leg assembly comprised of four members having the same square cross-sectional area, each of the same height, were simply placed beneath a flat table top, the contact area would be four square units (or nine square inches if two-by-twos were used). The present invention, on the other hand, has a total surface contact of ten square units (or twenty-two and one-half square inches when two-by-twos are used) in all three planes.

If a table having a similar appearance were constructed with legs also formed of four members having a square cross-section and mounted to a table top two units thick having a cut-out, two units by two units at each corner to accommodate the leg, each leg would only have a total surface contact of eight square units (or eighteen square inches) with the table top.

The advantages of the structure of the present invention are even more significant when considered with regard to distributing the contact surfaces among the three surfaces of contact: longitudinal, lateral and vertical. This invention provides two square units of surface contact in the vertical direction, four square units of surface contact laterally and four square units surface contact longitudinally. The first conventional structure discussed above has four square units of contact vertically and no contact laterally or longitudinally. Such a table would be expected to exhibit a tendency to wobble. Likewise, the second conventional structure (having a two unit by two unit notch in each corner) would provide the same four square unit surface contact in both the lateral and longitudinal directions; however, it would not offer any surface contact in the vertical direction. Again, such table would be substantially weaker than a table constructed in accordance with the present invention.

It should also be understood that the present invention can be constructed with a solid leg. The leg can have substantially any cross-section in the bottom extending portion of the leg, remote from the area of contact with the body of the article of furniture provided the top portion is shaped to be received by the body of the article of furniture. A leg having a top portion of square cross-section of two units by two units can be made suitable to this invention by holding the leg in a vertical position and making vertical cuts along both the lateral and longitudinal center lines to a depth of two units. Next, a horizontal cut is made across one entire side of the leg at a distance of one unit from the top and a depth of one unit from the side surface. Finally, a second horizontal cut is made parallel to the first cut, but at a distance of two units from the top surface. This cut is only made a horizontal distance of one unit thereby resulting in a leg having an "L" shaped notch cut out of half its cross-section.

When the leg structure of the present invention utilizes a solid leg, the first portion 46 of the leg is equivalent to the upper part of the combination of the first and second members 24, 26 in a leg assembly formed from four individual members. Likewise, the second portion 48 is equivalent to third member 28 and the third portion 50 is equivalent to fourth member 30. The bottom extending portion 52 is the end of the leg remote from first, second and third portions 46, 48, 50.

Figure 7:
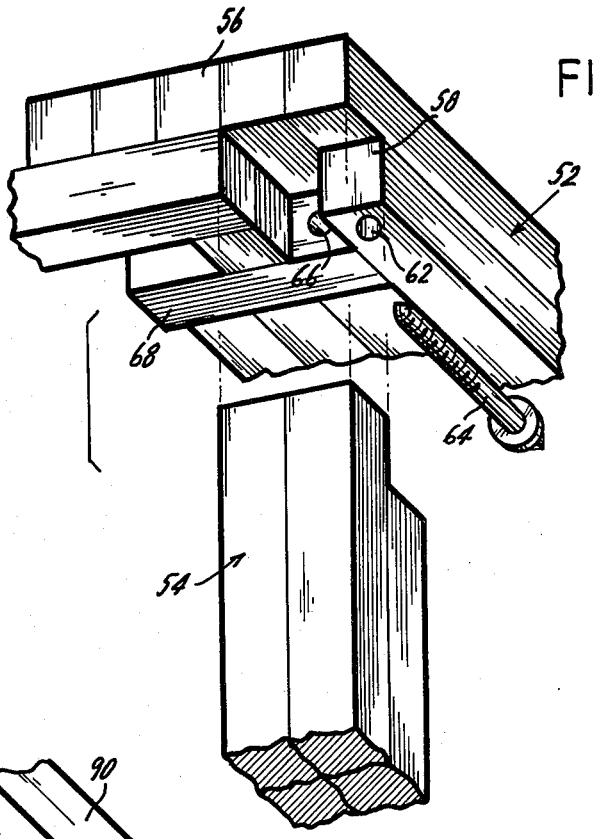
FIG. 7 is a bottom perspective view of a corner of an assembly of an alternate embodiment of the present invention with the leg assembly detached from the table top.
Figure 8:
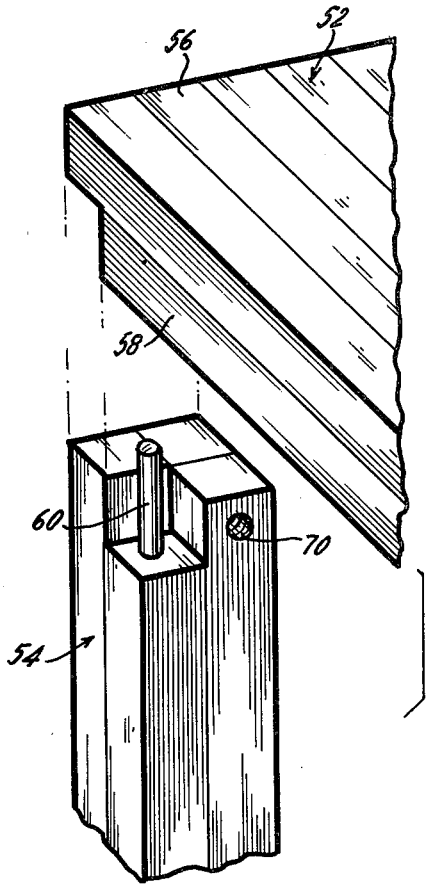
FIG. 8 is a perspective view of the table and disassembled leg assembly of the alternate embodiment of the present invention shown in FIG. 7 rotated 90° in a clockwise direction.

An alternate embodiment of the present invention is shown in FIGS. 7 and 8. Specifically, this leg structure is comprised of a table top assembly 52 and a leg assembly 54. The top portion 56 of table top assembly 52 has conventional squared corners which are not notched.

As best shown in FIG. 7, the bottom of table top assembly 52 is formed with a recess one unit deep extending two units laterally and two units longitudinally which is intersected by longitudinal skirt 58 extending downwardly one unit for a longitudinal and lateral distance of one unit in each direction. These elements form an L-shaped recess extending laterally two units inwardly from the side of table top assembly 12 and longitudinally two units inwardly from the end of the assembly for a width of one unit located one unit inwardly from the side of table top assembly 52.

Leg assembly 54 contains an upper portion that is correspondingly shaped to be engaged within table top assembly 52. Specifically, leg assembly 54 is comprised of an uppermost cross-section having an L-shaped configuration formed from a square cross-section two units by two units, minus a smaller square, one unit by one unit extending for one unit below the top surface. Pin 60 extends upwardly from leg assembly 54 and is received in a corresponding locating hole 62 in longitudinal skirt 58. The leg assembly 54 is maintained in engagement with table top 52 by a lag bolt 64 through a clearning hole 66 in lateral strut 68 engaging pilot hole 70 in leg assembly 54.

Assuming the alternate embodiment of the leg structure of the present invention as shown in FIGS. 7 and 8 is constructed out of materials having a unit dimension of one and one-half inches, such as the type of lumber known as "two-by-twos," the resultant structure will have a total contact area of nine square units or twenty and one-quarter square inches in all three planes. Specifically, there are four square units of surface contact in the vertical direction, three square units of surface contact in a lateral direction and two square units of surface contact in the longitudinal direction.

Figure 9:
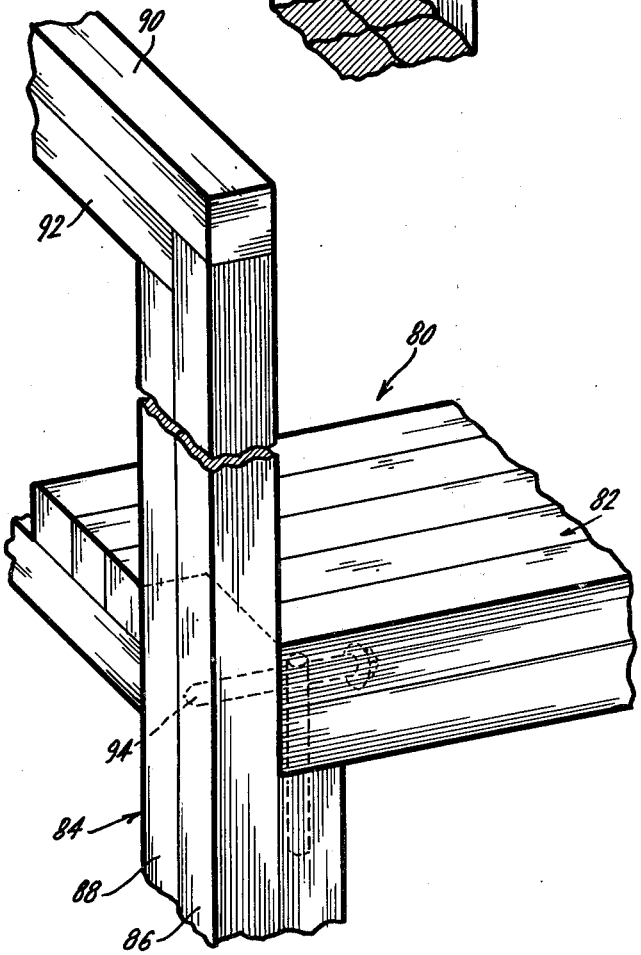
FIG. 9 is a perspective view of a back corner portion of a chair constructed in accordance with the present invention.

FIG. 9 shows the details of construction of a back corner of a chair incorporating the leg structure of the present invention. Specifically, the chair 80 is constructed of a chair assembly 82 and a leg/back assembly 84. In this embodiment, first and second members 86, 88 of leg/back assembly 84 extend upwardly past the top surface of chair assembly 82. A cross-piece shown as having a top and bottom member 90 and 92 respectively form the back rest of the chair structure incorporating the present invention. Of course, the back rest can be formed in any desirable manner.

The leg/back assembly 84 is held in engagement with chair assembly 82 by a lag bolt 94 in the manner described above.

Although the invention herein has been described with reference to a particular embodiment, it is to be understood that this embodiment is merely illustrative of the principles of the application of the invention. Thus, it is to be understood that numerous modifications may be made in the illustrative embodiment and other arrangements may be devised without departing from the spirit and scope of the invention and, consequently, the claims appended hereto should be broadly construed.

What is claimed is:

1. A leg structure for an article of furniture such as a table, chair or the like comprising: a leg having a top engaging portion and a bottom extending portion, said top engaging portion having a first portion extending at least the full height of said leg, a second portion extending less than said first portion and a third portion extending less than said second portion and a unitary furniture assembly constructed and arranged to engage said top engaging portion of said leg and having a first leg portion receiving cavity and second leg portion receiving cavity wherein said first leg portion receiving cavity is defined by substantially vertical surfaces in three different adjacently perpendicular vertical planes engaging substantially all of the corresponding substantially vertical surface of said top engaging portion of said first portion of said leg in corresponding three relatively perpendicular vertical planes whereby horizontal movement of said leg in three perpendicular directions is prevented by said substantially vertical surfaces of said first leg portion receiving cavity engaging substantially all of said corresponding substantially vertical surface of said top engaging portion of said first portion of said leg.

2. The leg structure as recited in claim 1 wherein said top engaging portion has a substantially square cross-section.

3. The leg structure as recited in claim 2 wherein said first portion has a rectangular cross-section and each of said second and said third portions has a square cross-section.

4. The leg structure as recited in claim 1 wherein said first portion of said leg is defined by a vertical medial plane through said leg, said second portion is defined by said vertical medial plane and a second vertical medial plane perpendicular to said first vertical medial plane.

5. A leg structure for an article of furniture such as a table, chair or the like comprising a leg assembly having four members of square unit cross-section, a first and second member of said leg assembly extending the entire length of said leg assembly, a third member of said leg assembly extending one unit less than the entire length of said leg assembly, and a fourth member of said leg assembly extending two units less than the entire length of said leg assembly; a furniture assembly including a top portion having a thickness of one unit, a corner, a longitudinal skirt extending downwardly from the bottom of said top portion and a lateral skirt extending downwardly from said bottom of said top portion, said skirts intersecting at said corner and extending downwardly one unit laterally for a distance starting two units from said corner of said furniture assembly and one unit longitudinally from said corner, said furniture assembly further includes a cut-out extending upwardly and inwardly two units laterally through said lateral skirt and said top portion and extending upwardly and inwardly one unit longitudinally through said longitudinal skirt and said top portion; and means for detachably fastening said leg assembly to said furniture assembly.

6. A leg structure as recited in claim 5 further including a pin extending upwardly substantially one unit from said fourth member of said at least four members of said leg assembly and said longitudinal skirt further including a pin receiving hole.

7. A leg structure as recited in claim 5 further including a laterally extending strut member, extending downwardly at least one unit from the bottom of said top portion of said furniture assembly, spaced from said lateral skirt a distance of one unit, wherein said leg fastening means is a fastener passing through said lateral strut member engaging said third member of said leg assembly.

8. A chair having at least one detachable leg structure as recited in claim 1 or claim 5.

9. A table having at least one detachable leg structure as recited in claim 1 or claim 5.

10. A leg structure for an article of furniture such as a table, chair or the like, comprising a leg and a furniture structure having a leg engaging portion, said leg engaging portion is formed from an L-shaped recess beneath the top surface of said furniture structure defined by three substantially vertical surfaces in three different adjacently perpendicular planes and said leg contains a top furniture structure engaging portion having an L-shaped cross-section of corresponding dimension to said L-shaped recess whereby said L-shaped cross-section is receivable in said L-shaped recess and horizontal L-shaped recess and horizontal movement of said leg is prevented in three different relatively perpendicular directions.

11. A leg structure for a chair comprising a leg assembly and a chair structure, said chair structure having a notch and said leg assembly having a first leg portion extending upwardly past said chair structure within said notch, a second leg portion engaging a bottom of said chair structure and a third leg portion, said chair structure having a second leg portion engaging recess and means for fastening said leg assembly to said chair structure.

12. A leg structure for an article of furniture such as a table, chair or the like comprising: a leg having a top engaging portion and a bottom engaging portion, said top engaging portion having a first portion extending at least the full height of said leg, a second portion extending less than said first portion and a third portion extending less than said second portion, a furniture assembly constructed and arranged to engage said top engaging portion of said leg and a pin extending upwardly from said third portion of said leg and a pin receiving hole in said furniture assembly in engaging relationship to said pin.

* * * * *